United States Patent [19]

Janssen et al.

[11] Patent Number: 4,981,510

[45] Date of Patent: Jan. 1, 1991

[54] PROCESS AND APPARATUS FOR THE PRODUCTION OF FERROCHROMIUM

[75] Inventors: Wilhelm Janssen, Mülheim; Klaus Ulrich, Heiligenhaus, both of Fed. Rep. of Germany

[73] Assignee: Fried.Krupp Gesellschaft, Essen, Fed. Rep. of Germany

[21] Appl. No.: 389,591

[22] Filed: Aug. 4, 1989

[30] Foreign Application Priority Data

Aug. 6, 1988 [DE] Fed. Rep. of Germany ..... 3826824

[51] Int. Cl.[5] ..... C22B 4/00

[52] U.S. Cl. ..... 75/10.34; 75/10.63; 75/475; 266/163; 420/11

[58] Field of Search ..... 75/10.1, 10.63, 10.34, 75/10.46, 29, 33, 38; 266/248

[56] References Cited

U.S. PATENT DOCUMENTS

| | | | |
|---|---|---|---|
| 2,805,930 | 9/1957 | Udy | 75/10.46 |
| 2,830,891 | 4/1958 | Udy | 75/10.46 |
| 3,224,871 | 12/1965 | Collin | 75/10.46 |
| 4,629,506 | 12/1986 | Ulrich | 75/10.63 |
| 4,731,112 | 3/1988 | Hoffman | 75/10.63 |
| 4,772,316 | 9/1988 | Radke et al. | 75/21 |

FOREIGN PATENT DOCUMENTS

| | | |
|---|---|---|
| 3347686 | of 1985 | Fed. Rep. of Germany . |
| 3422267 | of 1985 | Fed. Rep. of Germany . |
| 3518555 | of 1986 | Fed. Rep. of Germany . |
| 854489 | of 1985 | South Africa . |

*Primary Examiner*—Peter D. Rosenberg
*Attorney, Agent, or Firm*—Spencer & Frank

[57] ABSTRACT

A process and apparatus for producing ferrochromium having a carbon content ranging from about 0.02 to about 10 weight percent includes providing a mixture comprised of iron-containing chromium ore, coal, and at least one slag former selected from each of a slag former of group (a) and a slag former of group (b), wherein the slag former of group (a) is selected from the group consisting of CaO and MgO, wherein the slag former of group (b) is selected from the group consisting of $Al_2O_3$ and $SiO_2$, and wherein the mixture has an ore or coal ratio ranging from 1:0.4 to 1:2. The mixture is heated in a rotary furnace for a period ranging from 20 to 240 minutes in a CO-containing atmosphere and at a temperature ranging from 1480° to 1580° C. to provide a reaction product. The reaction product is discharged from the rotary furnace in a doughy state and is cooled, either during or after discharging the reaction product from the rotary furnace, by mixing the reaction product with at least one additive effective for heating and decarbonation for a subsequent melting step, which at least one additive is at ambient temperature prior to being admixed, so that the mixture has a reduced temperature and is in a solid state as it is conveyed to a melting furnace. Finally, the mixture is melted in the melting furnace as a temperature ranging from 1600° to 1700° C. to obtain ferrochromium.

19 Claims, 1 Drawing Sheet

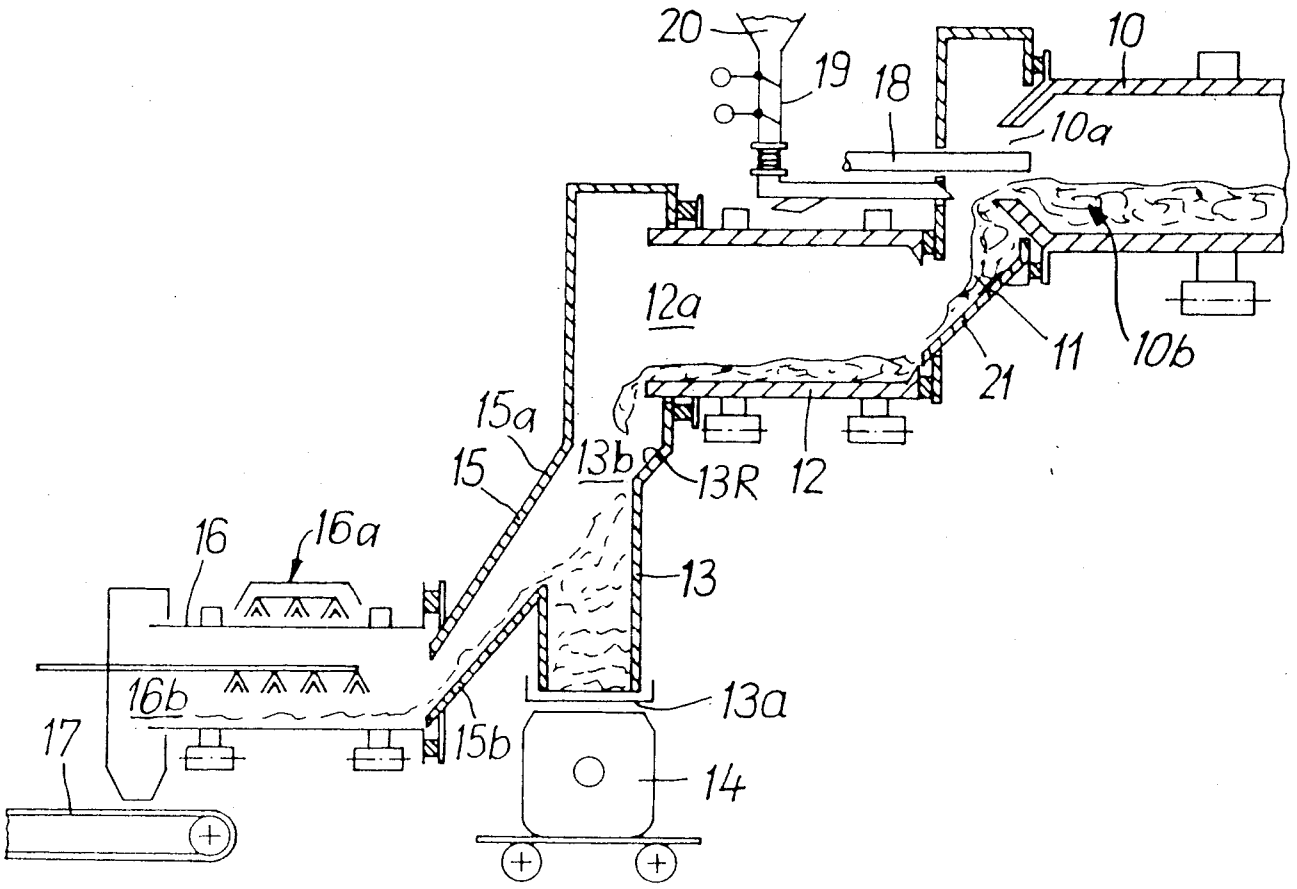
10
10a
10b
11
21
18
19
20
12
12a
13R
13
13a
13b
14
15a
15
15b
16a
16
16b
17

PROCESS AND APPARATUS FOR THE PRODUCTION OF FERROCHROMIUM

CROSS-REFERENCE TO RELATED APPLICATION

This Application claims the priority of Application Ser. No. P 38 26 824.8 filed Aug. 6, 1988, in the Federal Republic of Germany, the subject matter of which is incorporated herein by reference.

BACKGROUND OF THE INVENTION

1. Field of the Invention

The present invention relates to a process and apparatus for producing ferrochromium having a carbon content ranging from about 0.2 to about 10% from iron-containing chromium ores.

2. Description of the Related Art

Ferrochromium is an alloy composed of from about 20 to about 70% chromium, from about 0.02 to about 10% carbon, from about 0.05 to about 5% silicon, and a remainder comprised of iron and the usual, well-known impurities. Ferrochromium is formed by reduction-by-melting of iron-containing chromium ore, particularly chromium-iron rock, by melting the ore with coal according to the following equation:

$$FeCr_2O_4+4\ C=Fe+2\ Cr+4\ CO.$$

The reduction is effected by melting either a mixture of ore and coke chunks, or a mixture of ore pellets and coke, or a mixture of pre-reduced ore-fine-coke pellets and coke, particularly in a low shaft furnace or in an electric furnace. This results in alloys containing different amounts of carbon.

Ferrochromium is employed as a prealloy in the production of chromium steels. Very frequently high carbon-content ferrochromium alloys are undesirably obtained, but the carbon-content can be reduced by refining the alloys or by refining the chromium steel produced from the alloys. Chromium ores are generally composed of from about 20 to about 50% $Cr_2O_3$, from about 20 to about 40% FeO and from about 10 to about 70% rocky matter. It is difficult to separate out the rocky matter before smelting the ores, however, so that the high percentage of rocky matter in prior art reduction-by-melting processes must be separated from the resulting ferrochromium alloys as liquid slag. Since considerable amounts of $Cr_2O_3$ are included in the material to be reduced in addition to the high melting point rocky matter, the resulting slags have a high melting point. Thus, in spite of the addition of fluxing agents, melting temperatures of more than 1750° C. must be employed in order to maximize reduction and retrieval of chromium oxide out of the liquid slag in order to keep chromium losses as low as possible and maintain a low slag viscosity. The high temperatures required for such reduction-by-melting processes result in an undesirably high consumption of energy.

In order to be able to perform the reduction and melting processes at low temperatures with the use of carbon as the reduction agent and as the supplier of melting heat, German Pat. No. 3,347,686 proposes adding the slag formers CaO and/or MgO, as well as $Al_2O_3$ and/or $SiO_2$, in such quantities that the rotary furnace slag has a (CaO+MgO) to ($Al_2O_3+SiO_2$) ratio ranging from 1:1.4 to 1:10 and an $Al_2O_3$:$Si_2O$ ratio ranging from 1:0.5 to 1:5. The reaction product removed from the rotary furnace is comminuted to a particle diameter of less than 25 mm and is then separated by density separation and/or magnetic separation into a coal-containing fraction which is returned to the rotary furnace, at least one metal-containing, slag-rich fraction, and an alloy fraction to be transported into a melting furnace. The alloy fraction is then melted in the melting furnace at a temperature ranging from 1600° to 1700° C. to complete the separation of slag and metal.

To be able to effectively use magnetic separation, it has been further proposed that the reaction product removed from the rotary furnace be cooled to a temperature below the Curie temperature of ferrochromium so that the discharged material takes on ferromagnetic characteristics. Before magnetic separation, the cooled material must be comminuted in a breaker. The metal-containing slag phase and the metal phase are finally charged into a melting furnace into which, limestone dust is added, e.g., 8 kg CaO per minute, in order to reduce the sulfur content and ensure the required desulfuring to a residual sulfur level of 0.01% or less. The above-described process, however, is expensive and requires a corresponding amount of apparatus.

SUMMARY OF THE INVENTION

It is therefore an object of the present invention to improve the above-mentioned process and apparatus so that it is possible to perform the process and operate the apparatus without a reduction in product quality, in a more energy saving manner and with the use of less expensive apparatus.

It is a further object of the present invention that the material removed from the rotary furnace be prevented from caking together in large agglomerations, thus eliminating the need to empty intermediate containers and conveyors.

These and other objects are accomplished according to the present invention by a process for producing ferrochromium having a carbon content ranging from about 0.02 to about 10 weight percent from iron-containing chromium ore, the process including providing a mixture comprised of iron-containing chromium ore, coal, and at least one slag former selected from each of a slag former of group (a) and a slag former of group (b), wherein the slag former of group (a) is selected from the group consisting of CaO and MgO, wherein the slag former of group (b) is selected from the group consisting of $Al_2O_3$ and $SiO_2$, and wherein the mixture has an ore to coal ratio ranging from about 1:0.4 to about 1:2. The mixture is heated in a rotary furnace for a period ranging from 20 to 240 minutes in a CO-containing atmosphere and at a temperature ranging from 1480° to 1580° C. to provide a reaction product. The reaction product is discharged from the rotary furnace in a doughy state and is cooled, either during or after discharging the reaction product from the rotary furnace, by mixing the reaction product with at least one additive effective for heating and decarbonation for a subsequent melting step, which at least one additive is at ambient temperature, so that the mixture has a reduced temperature and is in a solid state as it is conveyed to a melting furnace. Finally, the mixture is melted in the melting furnace at a temperature ranging from 1600° to 1700° C. to obtain ferrochromium.

Thus, the reaction product, i.e., the material discharged from the rotary furnace, is mixed, during and/or after discharge from the rotary furnace, with additives which are at ambient temperature and which are required for the subsequent melting process, thus reducing the temperature of the reaction product to such an extent that it changes from a doughy state to a solid state. Advantageously, the process of the present invention requires no energy to comminute and cool the material leaving the rotary furnace in order to perform a density and/or magnetic separation thereon. Rather, the thermal energy of the material discharged from the rotary furnace is employed to heat the additives, which additives are supplied at ambient temperature, and to make available the quantity of energy required for endothermal reactions between the additive ingredients. Moreover, mixing action simultaneously prevents the formation of large agglomerates.

In an expedient embodiment of the invention, the additives required for the subsequent melting process cool the reaction product down to a temperature ranging from 600° to 1000° C., preferably, to a temperature ranging from 700° to 1000° C. The energy lost during cooling is utilized for heating, as well as for the necessary decarbonation of the additive, which additive is preferably at least one of limestone and raw dolomite. Preferably, the limestone and/or raw dolomite are added in a specific quantity ranging from 150 to 500 kg/t of material discharged from the rotary furnace.

According to another feature of the invention, the above-mentioned additives and the material discharged from the rotary furnace are mixed in a roller drum which is lined with refractory material so as to form a flowable granulate having a grain size ranging from a finite size up to 100 mm, preferably ranging from 10 to 100 mm, in diameter. The stated grain size is realized as a function of further process and system parameters in that the roller drum is rotated at a rate ranging between 1 and 10 rpm, preferably ranging between 3 and 7 rpm.

According to the prior art, a ratio of $(Al_2O_3+SiO_2)$:-$(CaO+MgO)$ in the slag of the pre-reduced material discharged from the rotary furnace ranges between 1.4 and 10 with an $SiO_2$:$Al_2O_3$ ratio ranging from 0.5 to 5. Thus, the slag phase after reduction reacts as a strong acid. In order to reduce the sulfur content in the metal phase during melting to, for example, 0.03%, a further feature of the invention provides for the addition of additives in a quantity sufficient to provide basicity in the slag phase after melting. Thus, the invention provides a slag phase after melting which contains at least one of CaO and MgO, has a $(CaO+MgO)$:$SiO_2$ ratio of greater than 1.1, preferably about 1.5, and reacts as a base.

Preferably, the material discharged from the roller drum is charged hot, i.e., at a temperature ranging from 600° to 1000° C., into a melting furnace. Charging is accomplished by means of a charging vessel and without further cooling. Preferably the melting furnace is an electric furnace.

The object of the present invention is additionally accomplished by an apparatus for performing a process for producing ferrochromium having a carbon content ranging from about 0.02 to about 10 weight percent from iron-containing ore, the apparatus including a rotary furnace heated in countercurrent and having a discharge opening. A roller drum is connected to the discharge opening of the rotary furnace and has a discharge end. Means for adding at least one additive, including means for quantity measurement of the at least additive, is positioned between the discharge opening of the rotary furnace and the roller drum. Finally, a hot charge vessel is positioned so that the discharge end of the roller drum lies above the hot charge vessel.

Such an apparatus arrangement advantageously eliminates the need for comminutors, separators, and cooling devices, as well as the conveyors required between them.

According to a modification of the apparatus according to the invention, the roller drum has a discharge means which is connected with a lined chute whose discharge opening lies above a mobile charging device. In this way, a system is created which approximates a closed system in order to obtain the lowest possible energy losses.

In order to prevent material from accumulating when there is a malfunction of the discharge opening of the above-mentioned lined chute, which could possibly lead to damage, the chute is provided with an overflow which opens into a drum which may be cooled. Advantageously, water may be employed as a cooling medium for the drum.

BRIEF DESCRIPTION OF THE DRAWING

The invention will now be described for one preferred embodiment thereof and with reference to the drawing. The sole drawing figure is a schematic illustration of an apparatus according to the invention.

DESCRIPTION OF THE PREFERRED EMBODIMENTS

A reduction process (reduction-by-melting process) conducted in a rotary furnace is well known and is, for example, disclosed in German Pat. No. 3,347,686 so that, except for the deviations to be discussed below, this reference is incorporated herein by reference. Preferred ways of heating to be utilized in the reduction process are also well known and are, for example, disclosed in German Pat. Nos. 3,422,267 and 3,518,555, the latter corresponding to U.S. Pat. No. 4,772,316, all of which are incorporated herein by reference.

The apparatus according to the invention comprises a rotary furnace 10 having a discharge opening **10*a* from which reaction product 11 is fed into a roller drum 12 whose discharge end 12*a* is connected with a lined chute 13. Lined chute 13 has a refractory lining 13R provided thereon, an upper opening 13*b* and a lower opening 13*a* which is a chute outlet 13*a* and is closeable. Chute outlet 13*a* permits measured discharge of reaction product 11 into a hot charge vessel 14 which is mobile. Lined chute 13 further includes an overflow 15 which projects laterally therefrom and which has a first end 15*a* connected to the lined chute 13 above the lower opening 13*a* thereof and a second end 15*b* leading to and opening into drum 16. Drum 16 is an emergency cooling drum and has cooling means 16*a* which may be a water cooling means. Materials conducted into drum 16 can be discharged through an outlet 16*b* thereof onto a conveyor belt 17**.

Iron-containing chromium ore charged into rotary furnace 10 is heated by the combustion of fine-grained coal conducted by way of a burner lance 18 into rotary furnace 10. Rotary furnace 10 is heated in countercurrent to the raw materials and the coal, which raw materials and coal are preferably preheated. Rotary furnace 10 is set for a temperature ranging from 1510° to 1560° C. at which temperature the charge to be reduced, composed of iron-containing chromium ores, carbon and slag formers, takes on a doughy state. In the doughy state, small metal droplets are formed in the charge and a portion of the particles of the charge to be reduced agglomerate. Rocky matter formed in the rotary and the metal phase furnace 10 are not yet separated, however. Moreover, disadvantageous baking of material onto furnace walls can be prevented by providing the rotary furnace 10 with, for example, a magnesite lining containing chromium oxide and/or coal and/or tar additives. $SiO_2$ required for slag formation is introduced into a lower zone 10*b*, shown on the left of rotary furnace 10, in which the charge to be reduced has a temperature of at least 1200° C. This is done in such a quantity so as to obtain the desired doughy consistency. This quantity can be calculated or determined experimentally. Material discharged from rotary furnace 10, i.e., reaction product 11, is mixed with additives 20 which are preferably limestone and/or raw dolomite and which are added through an adding device 19 in which quantities can be measured out.

Additives 20 are preferably added, as shown in the drawing, in the region above a slide 21 on which reaction product 11 leaves the rotary furnace 10. In a different arrangement, however, additives 20 can also be added directly into roller drum 12. In the figure, however, the above-mentioned additives 20 and reaction product 11 travel over slide 21 into a roller drum 12 which is lined with refractory bricks and which is moved at a rotational velocity which corresponds to a rate of rotation between 1 and 10 rpm. This rotary movement produces sufficient mixing of additives 20 with reaction product 11, while the limestone and/or raw dolomite additives, which are added at ambient temperature, simultaneously extract heat from reaction product 11, i.e., the energy consumed by the change for heating and for decarbonation. As a whole, reaction product 11 is discharged from the rotary furnace 10 and is cooled to a temperature ranging between 100° and 600° C. At the same time, additives 20 are heated up to the same temperature range. A mixture forms which has a solid state consistency unlike the material discharged from the rotary furnace 10 which has a doughy consistency. The rolling movement of roller drum 12, moreover, causes larger pieces to break apart and the material discharged from the roller drum 12 is a granular material having a distribution of grain sizes ranging from a finite size up to no more than 100 mm in diameter. This material can be filled through an upper opening 13*b* of lined chute 13 and through chute outlet 13*a* into a hot charge vessel 14. Hot charge vessel 14 then directly feeds the mixture into a melting furnace (not shown), which is preferably an electric furnace.

No more energy is required for the subsequent melting step of the process according to the invention than for prior art processes in which the additives are added directly to the melting furnace and the material discharged from the rotary furnace 10 is charged at its original temperature ranging from 1200° to 1500° C. What is unexpected about the present invention, however, is that such a process is achievable at all in view of the prior art belief that the danger of the material caking together and the destructive effect of the hot material would make the invention process impossible as a practical matter. Thus, the process according to the invention—preferably in conjunction with the apparatus according to the invention—accomplishes the necessary cooling of the material discharged from the rotary furnace 10 by mixing same with additives employed for heating and decarbonizing and having an ambient temperature so that the total energy requirement is not changed, only the temperatures of the individual components of the mixture. That is, the cooling of the material discharged from the rotary furnace 10 does not constitute a loss of energy for the subsequent melting process.

It will be understood that the above description of the present invention is susceptible to various modifications, changes and adaptations, and the same are intended to be comprehended within the meaning and range of equivalents of the appended claims.

What is claimed is:

1. A process for producing ferrochromium having a carbon content ranging from about 0.02 to about 10 weight percent from iron-containing chromium ore, the process comprising:

a. providing a mixture comprised of iron-containing chromium ore, coal, and at least one slag former selected from each of a slag former of group (a) and a slag former of group (b), wherein the slag former of group (a) is selected from the group consisting of CaO and MgO, wherein the slag former of group (b) is selected from the group consisting of $Al_2O_3$ and $SiO_2$, and wherein the mixture has an ore to coal ratio ranging from about 1:0.4 to about 1:2;

b. heating the mixture in a rotary furnace for a period ranging from 20 to 240 minutes in a CO-containing atmosphere and at a temperature ranging from 1480° to 1580° C. to provide a reaction product;

c. discharging the reaction product from the rotary furnace in a doughy state;

d. cooling the reaction product, either during or after discharging the reaction product from the rotary furnace, by mixing the reaction product with at least one additive effective for heating and decarbonation for a subsequent melting step, which at least one additive is at ambient temperature prior to being admixed, so that the mixture has a temperature which is reduced and is in a solid state as it is conveyed to a melting furnace; and e. melting the mixture in the melting furnace at a temperature ranging from 1600° to 1700° C. to obtain ferrochromium.

2. The process according to claim 1, wherein the temperature of the mixture in step d ranges from 600° to 100° C.

3. The process according to claim 2, wherein the temperature of the mixture in step d ranges from 700° to 1000° C.

4. The process according to claim 1 wherein the at least one additive comprises at least one of limestone and raw dolomite.

5. The process according to claim 4 wherein the at least one additive is mixed with the reaction product in step d in a quantity ranging from 150 to 500 kg/t of reaction product.

6. The process according to claim 1, wherein mixing of the at least one additive and reaction product in step d takes place in a roller drum lined with refractory material so as to form a flowable granulate as cooling takes place.

7. The process according to claim 6, wherein the flowable granulate has a grain size ranging from a finite size up to 100 mm.

8. The process according to claim 7, wherein the grain size ranges from 10 mm up to 100 mm.

9. The process according to claim 6, wherein the roller drum is operated at a rotational velocity which corresponds to a number of revolutions ranging from 1 to 10 rpm.

10. The process according to claim 9, wherein the number of revolutions ranges from 3 to 7 rpm.

11. The process according to claim 6, wherein the flowable granulate is discharged into a melting furnace without further cooling thereof.

12. The process according to claim 11, wherein the melting furnace is an electrically heated furnace.

13. The process according to claim 1, wherein melting in step e produces a slag phase, and wherein the at least one additive is mixed into the reaction product in a quantity effective to provide basicity in the slag phase.

14. The process according to claim 13, wherein the at least one slag former comprises CaO, MgO and $SiO_2$, and wherein the at least one additive is mixed into the reaction product in a quantity effective to provide a ratio of $(CaO+MgO):SiO_2$ in the slag phase of greater than 1.1 so that the slag phase reacts as a base.

15. Apparatus for performing a process for producing ferrochromium having a carbon content ranging from about 0.02 to about 10 weight percent from iron-containing ore, the apparatus comprising:

a rotary furnace heated in countercurrent and having a discharge opening;

a roller drum connected to the discharge opening of the rotary furnace and having a discharge end;

means for adding at least one additive, including means for quantity measurement of the at least additive, positioned between the discharge opening of the rotary furnace and the roller drum; and a hot charge vessel positioned so that the discharge end of the roller drum lies above the hot charge vessel.

16. The apparatus according to claim 15, further comprising a lined chute having a refractory lining provided therein and having an upper opening and a lower opening, the upper opening being positioned below the discharge end of the roller drum, and the lower opening being positioned above the hot charge vessel.

17. The apparatus according to claim 16, wherein the hot charge vessel is mobile.

18. The apparatus according to claim 16, further comprising a drum having a cooling means and an overflow having a first end and a second end, the first end being connected to the lined chute above the lower opening thereof and the second end leading to the drum.

19. The apparatus according to claim 16, wherein the drum is water cooled.

* * * * *